United States Patent [19]

Adams

[11] 4,000,687

[45] Jan. 4, 1977

[54] METHOD FOR ERECTING CARTONS

[75] Inventor: Charles W. Adams, Walton, Ky.

[73] Assignee: R. A. Jones & Co. Inc., Covington, Ky.

[22] Filed: Mar. 3, 1975

[21] Appl. No.: 554,767

[52] U.S. Cl. ..... 93/53 M; 93/53 R

[51] Int. Cl.[2] ..... B31B 1/78

[58] Field of Search ..... 93/53 R, 53 BF, 53 M, 93/49 R, 53 SD, 36 R, 49 M; 53/186

[56] References Cited

UNITED STATES PATENTS

| | | | |
|---|---|---|---|
| 3,029,711 | 4/1962 | Griese | 93/37 R |
| 3,476,024 | 11/1969 | Deering et al. | 93/53 R |
| 3,606,823 | 9/1971 | Allen | 93/53 R |
| 3,796,141 | 3/1974 | Mueller | 93/53 BF |

*Primary Examiner*—James F. Coan

*Attorney, Agent, or Firm*—Wood, Herron & Evans

[57] ABSTRACT

A conveyor mechanism conveys flat, tubular cartons having a central divider past an erecting station. During the conveying, two knives enter the carton from both ends and engage a bottom wall adjacent the divider and trailing side wall, respectively. The erecting mechanism engages the trailing side wall to swing it and the divider upwardly about the respective knives.

1 Claim, 4 Drawing Figures

METHOD FOR ERECTING CARTONS

This invention relates to a method and apparatus for erecting tubular cartons having a central divider. The invention is an improvement in the erecting apparatus of U.S. Pat. No. 3,476,024.

In the patented apparatus, flat folded carton blanks are conveyed through an erecting station having a transversely movable knife on each side of the conveyor. As the flat blanks move into the erecting station, the knives are moved toward each other until they achieve a full inward extension. There is a slight dwell in the longitudinal movement of the carton blank and at this point the knives overlie the bottom wall of the blank adjacent the trailing side wall of the blank. Mechanism engages the trailing side wall and pivots it upwardly about the knives until transport lugs of a transport conveyor move into engagement with the carton blank. As the transport conveyor lugs complete the erection of the carton, the knives are quickly withdrawn. Thereafter, the transport conveyor conveys the erected carton out of the erecting station.

While the mechanism of U.S. Pat. No. 3,476,024 has proved satisfactory for the erecting of conventional carton blanks, a problem arises in the erecting of carton blanks having central transverse dividers. The dividers normally consist of a strip glued to the top wall, a strip glued to the bottom wall and a free strip interconnecting the glued strips. While the free strip is scored adjacent the two glued strips, nevertheless, the stiffness of the chipboard from which the divider is formed causes a resistance to the erecting of the carton. More specifically, when a divided carton is held adjacent its trailing side wall by a knife and the trailing side wall is pivoted upwardly about the knife, the carton will not always open properly but rather will remain in flat folded condition and "elbow" or bend into an L shape. This is particularly true when the cartoning apparatus is run at high speeds.

The objective of the present invention has been to provide an improvement in the erecting mechanism of U.S. Pat. No. 3,476,024 which will enable divided cartons to be erected consistently and at high speeds without elbowing. This objective of the invention is achieved by adding to the erecting mechanism a second pair of knives downstream from the first pair of knives, the second pair of knives being adapted to enter the carton and lie against the bottom wall adjacent the divider when the carton pauses to be erected.

It appears that the entry of the downstream knives into the carton and the location of them immediately adjacent the divider begins to break the score between the divider strip and the glue strip on the bottom wall sufficiently to overcome the resistance to high speed opening normally attending a divided carton.

Because of the need to "insert" into each carton a pair of longitudinally spaced knives as contrasted to the single knife of U.S. Pat. No. 3,476,024, it has been another feature of the invention to provide for a more rapid transverse stroke of the knives in order to permit the knives to have a sufficiently great penetration into the carton over half the length of travel of the carton.

The foregoing modifications of the apparatus of U.S. Pat. No. 3,476,024 have given the apparatus the capability of erecting divided cartons without the incidence of elbowing or bowing.

The several features and objectives of the invention will become more readily apparent from the following detailed description taken in conjunction with the accompanying drawings in which.

Figure 1:
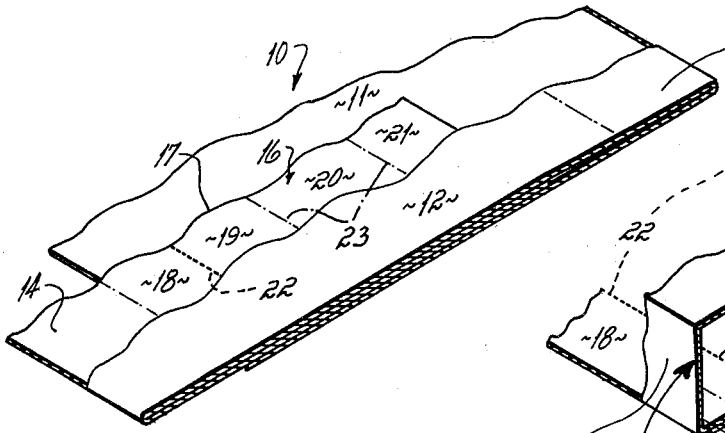
FIG. 1 is a fragmentary, perspective view partly in section of a flat folded carton blank.
Figure 2:
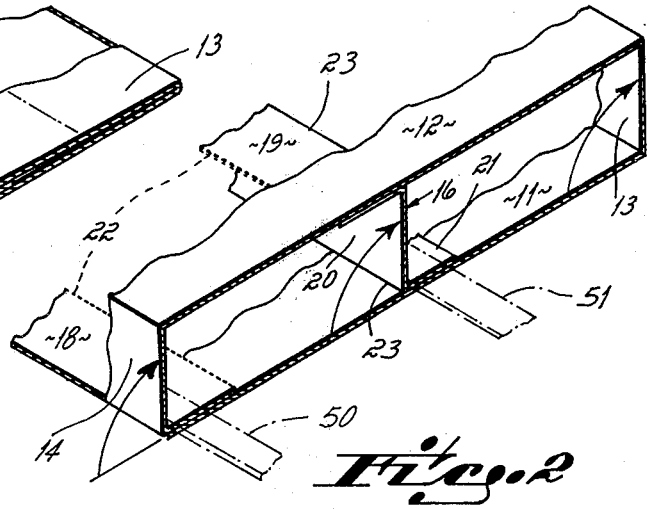
FIG. 2 is a view similar to FIG. 1 showing a carton blank in erected position.

Referring to FIGS. 1 and 2, a carton blank 10 has a bottom wall 11, a top wall 12, a leading upwardly facing side wall 13 and a trailing downwardly facing side wall 14. The side wall interconnect the top and bottom walls to form a tubular carton.

The carton has a divider 16. As illustrated in FIG. 1, the divider initially is formed as an extension 17 of the trailing side wall 14. The extension 17 has four strips 18, 19, 20 and 21. The first strip 18 is glued to the bottom wall and ultimately forms a glue flap for the carton. The second strip 19 is initially attached to the first strip along a perforated line 22 and is glued to the top wall 12. The perforation line is broken by the carton manufacturer before the blanks are fed to the cartoning machine. The third strip 20 is not glued to either top or bottom wall and forms an actual transverse dividing wall 16 in the center of the carton. The fourth strip 21 is glued to the bottom wall.

Figure 3:
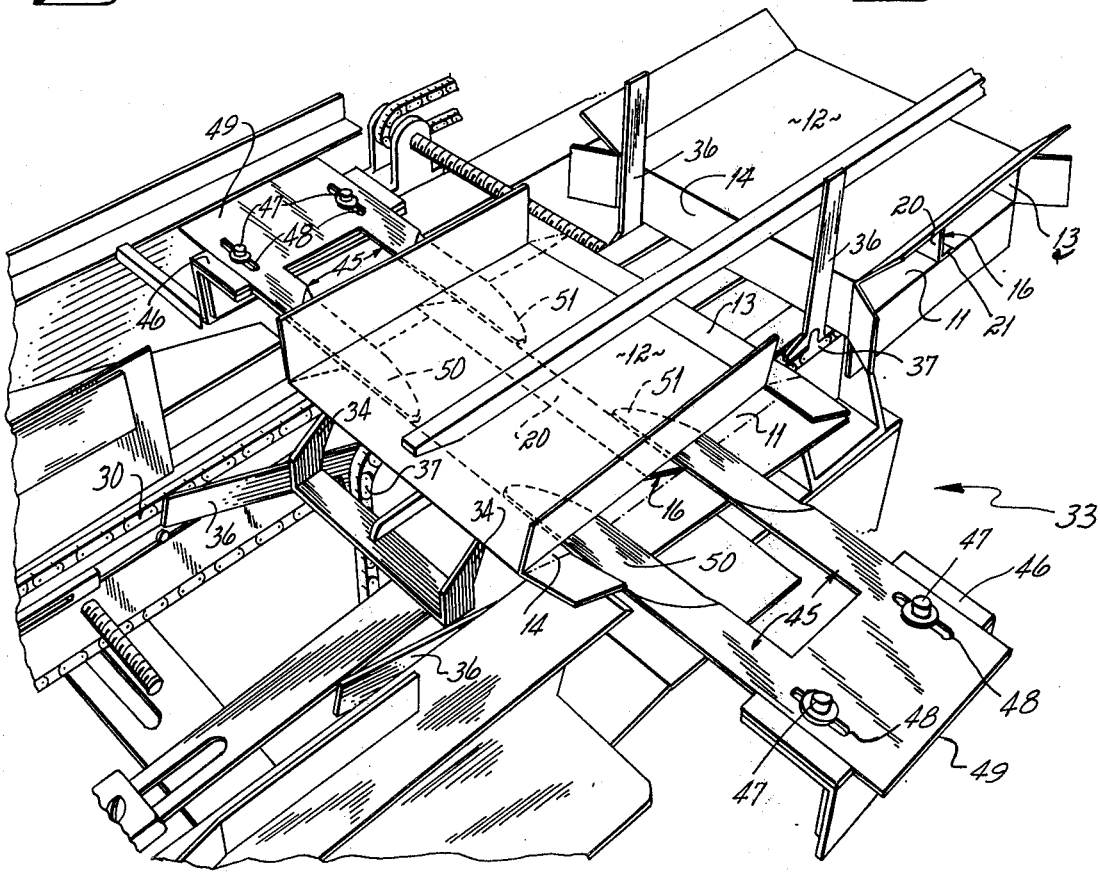
FIG. 3 is a fragmentary, perspective view of the erecting station.

The cross section of the carton 10 in its erected condition is shown in FIG. 2 wherein it can be seen that the divider 16 is formed by the strip 20 connected by the strips 19 and 21 to the top and bottom walls, respectively. The free strip 20 is hinged to the glued strips 19 and 21 along score lines 23. While the score lines weaken the chipboard to some extent, there remains a resistance to the erecting of the carton such as tends to cause elbowing when the railing side wall 14 is pivoted about its juncture with the bottom wall. That elbowing is overcome by the erecting apparatus illustrated in FIGS. 3 and 4.

Much detail has been eliminated from the present application in view of the fact that it is not directly related to the present erecting apparatus and to the extent that it is needed, it can be found in U.S. Pat. No. 3,476,024. Flat folded carton blanks are fed from a magazine (not shown) in the left side of the apparatus of FIG. 3, the blanks moving from left to right. The blanks are carried by a first endless conveyor chain 30 having spaced lugs 31 which engage the rear edge of each carton blank and move it toward an erecting station 33. At the erecting station, the first conveyor 30 gives up control of the blank, permitting a momentary pause in its excursion through the erecting station. During the momentary pause, the trailing edge 14 is pivoted upwards slightly by a pair of fingers 34 which are raised by a cam operated lever 35 timed to the machine. When the trailing wall 14 is partially pivoted upwardly, it is engaged by trailing transport lugs 36 mounted on a pair of lateral transport conveyor chains 37. The leading edge of the carton is at the same time in engagement with a leading transport lug 39 on a central transport conveyor chain 40.

Figure 4:
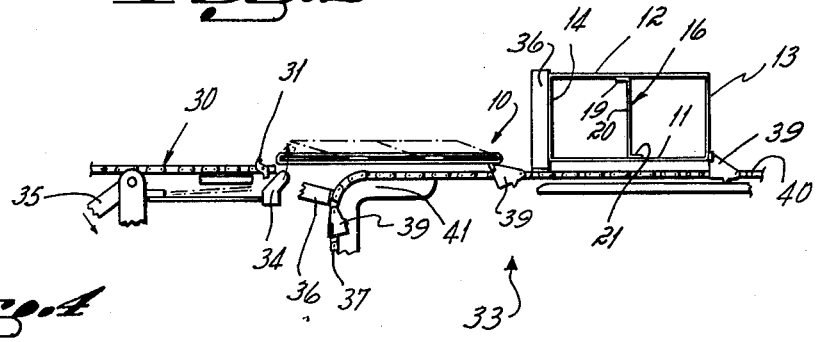
FIG. 4 is a diagrammatic side elevational view of the erecting station.

As can be seen in FIG. 4, the lateral chains pass around an arcuate track 41, and in so doing swing the trailing transport lug 36 from a generally horizontal attitude to a vertical attitude. The latter part of that swinging movement brings the trailing lug 36 into engagement with the trailing side wall of the carton, swinging it to vertical position, thereby completing the erection of the carton.

Absent any assistance in controlling the carton from within the carton, a significant number of cartons will not open properly but will rather remain in flat folded form and bend or elbow to a generally L-shaped configuration.

To eliminate the elbowing, the invention provides, on each side of the erecting station, a pair of knives 45. Each pair of knives is mounted on a bracket 46 by bolts 47, the bolts passing through transverse slots 48 in the base 49 of the pair of knives. The slot and bolt connection permits transverse adjustability as well as interchangeability of the knives, thereby adapting the apparatus to different sizes of cartons.

The knives have an upstream blade 50 and a downstream blade 51 which are projectable into the carton blanks. Each blade has a thickness of approximately one-fourth inch at its upstream edges. Normally, as the carton passes into the erection station the knives are transversely withdrawn so that the leading side wall 13 and the divider 16 can pass by the knives. As soon as the leading edge of the carton has passed the knives, the knives are rapidly moved transversely into the carton. Just as the carton pauses at the position shown in FIG. 3, the knives have achieved the extent of their insertion into the carton. The insertion of blade 51 with its finite thickness effects a partial break of the score line 23 between divider strip 20 and glue strip 21.

During the pause, the fingers 34 engage the trailing side wall to swing it in an upper direction, thereby beginning the erection of the carton. The upstream blade 50 holds the bottom wall of the carton while the trailing side wall 14 is partially swung upwardly, thereby providing the partial break of the hinge line between side wall 14 and glue flap 18. Thus, the cooperating engagement of the blades 50 and 51 with the bottom wall adjacent the juncture with the bottom wall of the divider wall 20 and trailing wall 14 stabilizes the carton and provides the necessary resistance to elbowing as the trailing wall is initially pivoted upwardly by the fingers 34. Each blade provides a different function. Blade 50 provides a fulcrum about which to swing side wall 14 and blade 51 prebreaks the score line at the divider 20.

Once the proper erecting of the carton has started and the top wall is spaced from the bottom wall, the withdrawl of the knives 45 is started to enable the knives to complete their withdrawal before the trailing transport lug 36 begins to move to carton dowstream from the erecting station.

I claim:

1. The method of erecting tubular cartons each having top and bottom walls, a leading upwardly facing side wall, a trailing downwardly facing side wall and a central divider secured along score lines to said top and bottom walls, comprising the steps of, engaging said bottom wall adjacent said trailing wall to provide a fulcrum about which to swing said trailing wall, simultaneously engaging said bottom wall adjacent said divider to partially break the score line adjacent said bottom wall, and pivoting said trailing side wall upwardly about its juncture with said bottom wall to effect simultaneous vertical orienting of said side walls and said central divider.

* * * * *